US007004461B2

(12) United States Patent
Hansmann et al.

(10) Patent No.: US 7,004,461 B2
(45) Date of Patent: Feb. 28, 2006

(54) DEVICE FOR ISOLATING AND FEEDING THE LOWEST SHEET IN EACH CASE FROM A STACK

(75) Inventors: Rolf Hansmann, Rahden (DE); Dieter Lörken, Düren (DE)

(73) Assignee: Kolbus GmbH & Co. KG, Rahden (DE)

( * ) Notice: Subject to any disclaimer, the term of this patent is extended or adjusted under 35 U.S.C. 154(b) by 279 days.

(21) Appl. No.: 10/442,412

(22) Filed: May 21, 2003

(65) Prior Publication Data

US 2003/0234483 A1 Dec. 25, 2003

(30) Foreign Application Priority Data

May 25, 2002 (DE) ..... 102 23 350

(51) Int. Cl.
*B65H 3/64* (2006.01)

(52) U.S. Cl. ..... 271/132; 271/137; 271/138; 271/139; 271/142; 271/144; 271/10.16

(58) Field of Classification Search ..... 271/10.14, 271/10.16, 131, 132, 137, 138, 139, 142, 271/144, 107

See application file for complete search history.

(56) References Cited

U.S. PATENT DOCUMENTS 2,756,113 A * 7/1956 Greenwood ..... 384/13
2,827,290 A * 3/1958 Dixon et al. ..... 271/99
3,754,752 A * 8/1973 Thayer ..... 271/132
3,767,186 A * 10/1973 Shields ..... 271/132
3,923,297 A * 12/1975 Barny ..... 271/132
4,008,889 A * 2/1977 Ayres ..... 271/99

(Continued)

FOREIGN PATENT DOCUMENTS

DE 196 53 343 A1 12/1996

(Continued)

OTHER PUBLICATIONS

Force Engineering's "Introduction to Linear Motors" at website http://www.force.co.uk/page2.html □□ 1997 (site visited Apr. 28, 2005).*

(Continued)

*Primary Examiner*—Donald P. Walsh
*Assistant Examiner*—Matthew J. Kohner
(74) *Attorney, Agent, or Firm*—Alix, Yale & Ristas, LLP

(57) ABSTRACT

In a device for isolating and feeding the lowest sheet (1) in each case from a stack (2), with pushing-out elements (9) which grip the rear edge (3*a*, 3*b*) of the sheet (1) and transport it through, under a front-edge stop (5), into a pair of drawing-off rollers (6), can be moved forwards and backwards, are mounted on a cross-member (7) and have faces (9*a*), which are optionally front-mounted, for supporting the rear region of the stack (2) and also have bearing elements (11, 12) supporting the stack (2), and lateral abutment strips (13), the front edge (4) of the said stack being constant with respect to the sheet length (H), provision is made, in order to achieve high isolating outputs and faultless feeding of the sheets (1) with a device of simple design, for the cross-member (7) which receives the pushing-out elements (9) to be guided so as to be capable of travel in a linear guide (14), and for there to be directly associated with the said cross-member (7), for the driving movement of the latter, a linear motor (15) whose path of travel (A) comprises both the isolating stroke (B) and also an adjusting path (C) which is intended for setting the sheet length (H).

21 Claims, 2 Drawing Sheets

U.S. PATENT DOCUMENTS 4,131,208 A * 12/1978 Vuilleumier ..... 414/797.9
4,181,298 A * 1/1980 Capdeboscq ..... 271/5
4,202,541 A * 5/1980 Leskiw et al. ..... 271/132
4,227,687 A * 10/1980 Schoonmade ..... 271/139
4,273,321 A * 6/1981 Luther et al. ..... 271/10.14
4,363,478 A * 12/1982 Tsukasaki ..... 271/10.06
4,405,124 A * 9/1983 Watanabe ..... 271/135
4,630,812 A * 12/1986 Yano et al. ..... 271/132
4,715,596 A * 12/1987 Cantrell et al. ..... 241/116
4,783,064 A * 11/1988 Hayashi ..... 271/131
4,955,854 A * 9/1990 Roth ..... 225/103
5,123,887 A * 6/1992 Shimura ..... 493/34
5,145,161 A * 9/1992 Bowser et al. ..... 271/12
5,330,171 A * 7/1994 Murad et al. ..... 271/131
5,409,205 A * 4/1995 Macke, Sr. et al. ..... 271/133
5,423,619 A * 6/1995 Kohno ..... 400/525
5,464,203 A * 11/1995 Bowser et al. ..... 271/12
6,098,840 A * 8/2000 Ito et al. ..... 221/232
6,193,230 B1 * 2/2001 Tung-Ying ..... 271/124

FOREIGN PATENT DOCUMENTS

| | | | | |
|---|---|---|---|---|
| EP | 350749 | A2 | * | 1/1990 |
| EP | 0 464 578 | A1 | | 6/1991 |
| FR | 2632430 | A2 | * | 12/1989 |
| GB | 2145065 | A | * | 3/1985 |
| GB | 2209517 | A | * | 3/1985 |
| GB | 2274276 | A | * | 7/1994 |
| GM | 75 18 810 | | | 9/1975 |
| JP | 60036246 | A | * | 2/1985 |
| JP | 63101241 | A | | 5/1988 |
| JP | 63047243 | A | * | 12/1988 |

OTHER PUBLICATIONS

Summary of Germand Search Report for 102 23 350.0.

* cited by examiner

DEVICE FOR ISOLATING AND FEEDING THE LOWEST SHEET IN EACH CASE FROM A STACK

BACKGROUND OF THE INVENTION

The present invention relates to a device for isolating and feeding the lowest sheet in each case from a stack of flat substantially planar items such as paper sheets or the like.

A device of the type is known, for example, from EP 0 464 578 A1 and serves for isolating boards which are fed to a subsequent unit for further processing. Possible further-processing operations are printing, cutting-to-size or division into a number of individual sheets, fluting or grooving and milling, the manufacture of book covers, file covers, etc. This device has a transporter which can be moved forwards and backwards and which is driven by a crank-slide mechanism with coupler-mechanism expansion with a sinusoidal movement pattern. Fastened to the transporter are pushing-out elements which are dimensioned in such a way, in terms of their height, that they grip only the lowest sheet at the rear edge during the forward movement and push it through an admission aperture formed by a base plate and a front-edge stop. In the process, the sheet is pushed into a pair of drawing-off rollers which takes over the transportation of the sheet from then on and feeds it to the subsequent processing unit, while the transporter with the pushing-out elements returns to its starting position for the purpose of pushing out the next sheet. From DE 75 15 810 U1, a device is known in which a suction device which acts upon the front region of the lowest sheet is additionally provided for the purpose of isolating and feeding curved materials.

The sheets rest against a stationary edge with their front edge. Accordingly, as the sheet length becomes greater, the rear edge is displaced rearwards relative to the front edge stop and to the pair of drawing-off rollers. For the purpose of setting different sheet lengths, the transporter with its appertaining drive is received in a carriage which can be brought, via adjusting spindles, into the pushing-out position which corresponds to the sheet length. For the purpose of driving the crank-slide mechanism, a rotating movement is tapped off, via a sliding sleeve, from a spline shaft aligned along the direction of displacement, and is reoriented via a bevel-gear mechanism. The prior art mentioned also indicates an alternative form of embodiment for adjusting the pushing-out position. In that embodiment, the mechanism for generating the forward and backward movement is disposed in a stationary manner. It actuates a sliding carriage which has a transporter which can be adjusted via adjusting spindles. The rotational movement for adjustment purposes is transmitted in known manner via a sliding sleeve from a profiled shaft to the moving system of the sliding carriage.

Because of the disposition of the adjusting system on the moving system, the latter is burdened by additional masses for which allowance has to be made in the guides of the carriage and also in the drive and which, moreover, restrict the maximum isolating output. The driving connection of the adjusting system via sliding sleeves is exposed to constant wear. Although the moving mass is reduced to a minimum in the aforesaid form of embodiment, use is nevertheless made of a very complicated driving system which has, in the sliding sleeve, a driving member which is subject to play and wear.

The sinusoidal driving movement of the transporter which is generated via the crank-slide mechanism or, in other embodiments, via a crank mechanism has ranges of maximum, near-constant speed during both the forward and the backward movements. The taking-over of the sheet during the forward movement through the pair of drawing-off rollers ideally takes place within this speed range, and that at a speed which is synchronous with the said pair of rollers. In order to achieve high isolating outputs and/or in the case of large sheet lengths, however, the drawing-off speed is set so as to be substantially higher. This leads to the sheets being pulled in a skewed manner, which jeopardizes further processing of a good quality. Because of the fixed period of the sinusoidal driving movement, the sheets are fed to the pair of drawing-off rollers at a fixed clock-pulse interval. This is also necessary for some further-processing apparatuses. During cutting-to-size or division into a number of blanks, on the other hand, pushing-out of the sheets which is adapted to the sheet length is appropriate in order to achieve maximum isolating outputs, something which can be achieved only by means of major structural expense in the designs of drive indicated.

SUMMARY OF THE INVENTION

The underlying object of the present invention is to provide a device for isolating and feeding the lowest sheet in each case from a stack, which device permits high isolating outputs and faultless feeding of the sheets, while being of simple design.

The inventive concept resides in using a linear motor for the driving movement of the cross-member with the pushing-out elements, which cross-member is guided so as to be capable of travel in a linear guide, the path of travel comprising both the isolating stroke and also an adjusting path which is intended for setting the sheet length. Driving and adjusting members which are subject to play and wear are thereby eliminated, and the moving mass is markedly reduced. The driving movement is changed over in a low-friction manner. The device is distinguished by a particularly simple design—particularly when changing the setting over to different sheet lengths.

The mechanical decoupling of the drives of the drawing-off rollers and pushing-out system result in advantageous possibilities for configuring the movement profile of the forward and backward movements. A higher pushing-out speed with respect to the drawing-off speed is chosen instead of the synchronous transfer speed. Suitably stiff sheets are pushed, aligned more or less at the rear edge, into the drawing-off rollers without the latter pulling the sheet away from the pushing-out elements in a one-sided manner when gripping it for the first time. Two movement profiles can be configured in principle. Clock-pulse-synchronous feeding operations are thus possible with one and the same device, and so too are feeding operations with gaps of equal size between the sheets that are being fed.

The driving of the linear motor in a force-controlled manner, combined with the predetermining of an admissible pushing-out force, is advantageous if the speed of the pair of drawing-off rollers, and thereby of the isolating output, is controlled subject to adherence to the pushing-out force. This provides isolating and feeding operations which treat the product particularly gently. Allowance is made for different stack heights, to the effect that the pushing-out speed is reduced in the case of large stack heights because a higher proportion of the pushing-out force is needed for overcoming the surface friction and is no longer available for actually accelerating the sheet. It is expedient to cause the processing speed when the device is moved up along an approach ramp to be determined automatically through the fact that the pushing-out force exerted is compared with the admissible pushing-out force. In this context, "approach ramp" means that the device is running faster and faster (by beginning with a low processing speed) while the admissible pushing-out force is monitored. When the admissible pushing-out force is reached, the device is operated at the processing speed which has been reached up to that point.

The cross-member with the pushing-out elements is advantageously constructed with a suction device which acts upon the front region of the lowest sheet. By this means, thin or curved sheets can be reliably transported through under the front-edge stop. Under these circumstances, it is possible, in some cases, to dispense with the pushing-out elements.

BRIEF DESCRIPTION OF THE DRAWINGS

The invention will be explained in greater detail with the aid of an exemplified embodiment which is represented in the drawings, wherein.

DESCRIPTION OF THE PREFERRED EMBODIMENT

Figure 2:
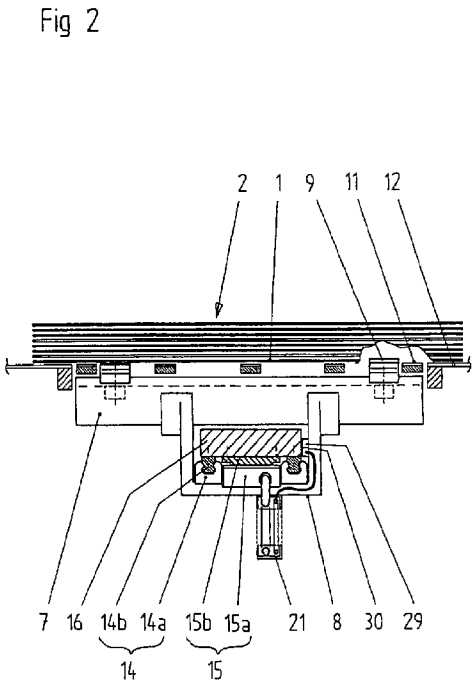
FIG. 2 shows the device in a sectional view along the sectional line II—II shown in FIG. 1.

A stack 2 which is to be isolated and which contains sheets 1 is located in a magazine or holder comprising rear limiting elements 20, front lateral abutment strips 13 and front-edge stops 5, and also bearing strips 11 and metal bearing plates 12 which form the lower limit and are fastened to front and rear bearers 18*a,b*. In the exemplified embodiment, the magazine is filled with sheets 1 which are arriving continuously via a conveyer belt 19. Filling with partial stacks by hand is equally possible.

Figure 1:
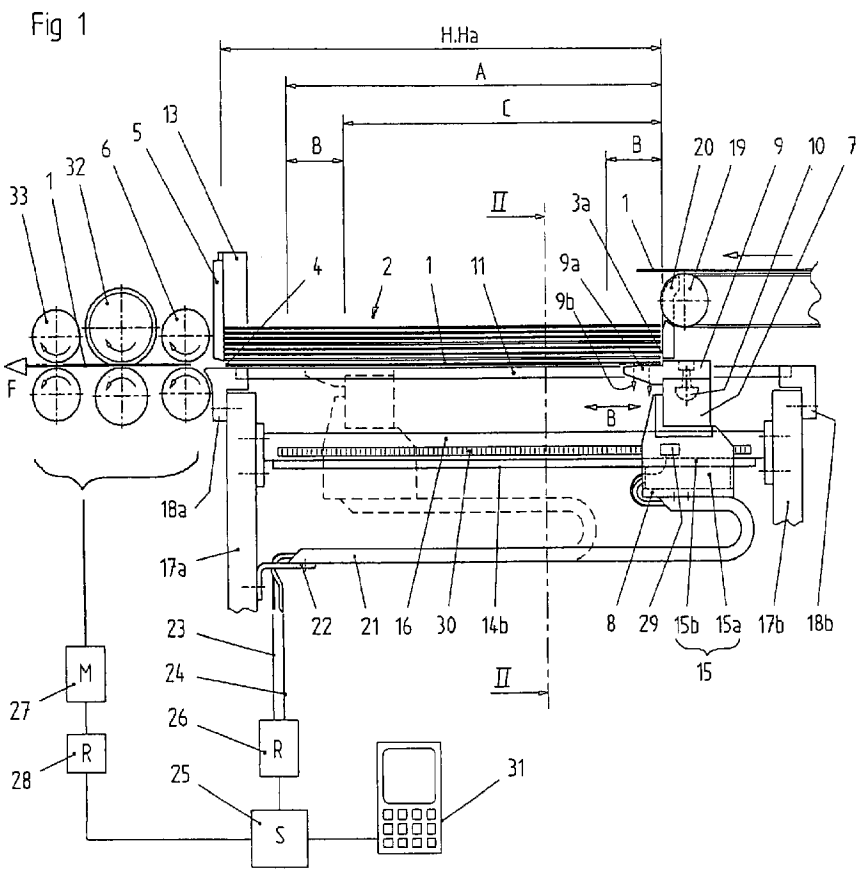
FIG. 1 shows the device according to the invention, in a side view.

For isolating the lowest sheet 1 in each case, a cross-member 7 (extending transversely to the conveying direction F) is provided which can be moved forwards and backwards and on which two pushing-out elements 9 with front-mounted bearing faces 9*a* are disposed in an adjustable and exchangeable manner via gripping-type fastening systems 10. During the forward movement, the lowest sheet 1 in each case is gripped at the rear edge 3*a,* 3*b* with the aid of that edge of the pushing-out elements 9 which is adapted to the sheet thickness and protrudes in relation to the bearing face 9*a,* and the said sheet is transported through, with its front edge 4 under the front-edge stops 5, into a pair of drawing-off rollers 6. From then on, the pair of drawing-off rollers 6 takes over the transporting operation in the direction of conveyance F and feeds the sheet to a subsequent further-processing unit. The shape of the face of the pushing out element 9 preferably includes a shoulder or notch whereby bearing surface 9*a* supports the bottom sheet from below while the shoulder pushes the bottom sheet. On the return stroke, the flat top surface to the right of the notch slides along the underside of the bottom of the next sheet. FIG. 1 shows, by way of example, a cutting device which is formed by knife shafts 32 and a pair of feeding-out rollers 33.

The cross-member 7 is guided so as to be capable of travel in a linear guide 14 which is formed from guide rails 14*b* disposed so as to be integral with the frame that supports the holder, and from guide carriages 14*a* fastened to the cross-member. Its driving movement is generated by a linear motor 15 which is directly associated with it. The primary part 15*a* of the motor is fastened to the cross-member 7 via a bracket 8, while the secondary part 15*b* is associated with a carrying plate 16 disposed, in a manner integral with the frame, between a front wall and a rear wall 17*a, b* of the frame. The length of the secondary part 15*b,* minus the length of the primary part 15*a,* produces approximately the maximum possible path of travel A of the linear motor 15. The entire linear motor 15 does not travel along the carrying plate 16. The primary part 15*a* moves actuated by electromagnetic forces relatively to the secondary part 15*b,* which includes permanent magnets and which is mounted fixed to the carrying plate. The guiding is realized by the linear guide 14 and defines the moving direction and the exact arrangement/relating of the primary and the secondary part to one another.

The forward and backward movement for isolating and pushing-out purposes is marked as the isolating stroke B in the drawings. The available adjusting path C, with the aid of which the location of the isolating stroke B can be set in dependence upon the sheet length H, is defined by the difference between the path of travel A and the isolating stroke B.

The cross-member with the pushing-out elements is advantageously constructed with a suction device 9*b*, which acts upon the front region of the lowest sheet. The suction device is located in the bearing face 9*a* of the pushing-out elements 9 and acts (as shown with dashed arrows) upon the underside of the lowest sheet 1 for drawing the sheet against the bearing face to secure the taking with by the pushing-out element 9.

For providing protection against falling dust and the like, the secondary part 15*b* of the linear motor 15 is mounted on the carrying plate 16 from below. The two guide rails 14*b* of the linear guide 14 are likewise fastened to the carrying plate in a torsion and deflection-resistant manner below, that is to say, to the left and right of, the secondary part 15*b*. The above mentioned bracket 8 on the cross-member 7, which cross-member is moved forwards and backwards, encloses the arrangement, which is integral with the frame, constituted by the carrying plate 16, the guide rails 14*b* and the secondary part 15*b*. The bracket also carries a scanning head 29 with the aid of which a material measure 30 attached laterally to the carrying plate 16 is scanned for the purpose of detecting the position of the cross-member 7 in an absolute manner.

The power cable 24, which is connected to the moving primary part 15*a,* and other signal lines 23 are laid in a trailing chain 21 which serves as a cable duct and is fastened by one end to the bracket 8 on the cross-member 7, and by the other end to a holder 22 on the front wall 17*a* of the frame. The other driving and controlling elements of the device are represented symbolically in FIG. 1. Associated with the linear motor 15 is a control system 26 which, in turn, receives its parameters which are necessary for operating purposes from a superordinated position-controlling system 25, or exchanges them. Also connected to the position-controlling system 25 are an operating unit 31 for indicating and inputting the parameters, as well as a motor-controlling system 28 which controls the motor 27 which drives the drawing-off roller system 6, the knife shafts 32 and the pair of feeding-out rollers 33. Via the operating unit 31 there is inputted, inter alia, the sheet length H according to which the linear motor 15 conveys the cross-member 7 into a suitable location or position on the path of travel A, from where the isolating stroke B is carried out as a cyclical forward and backward movement. Alternatively the location of the isolating stroke B on the path of travel A is determined automatically by driving the cross-member 7 with the pushing-out elements 9 against the rear edge 3*a,* 3*b* of the stack 2 from an outer position, which is controlled by a sensor 34.

Figure 3:
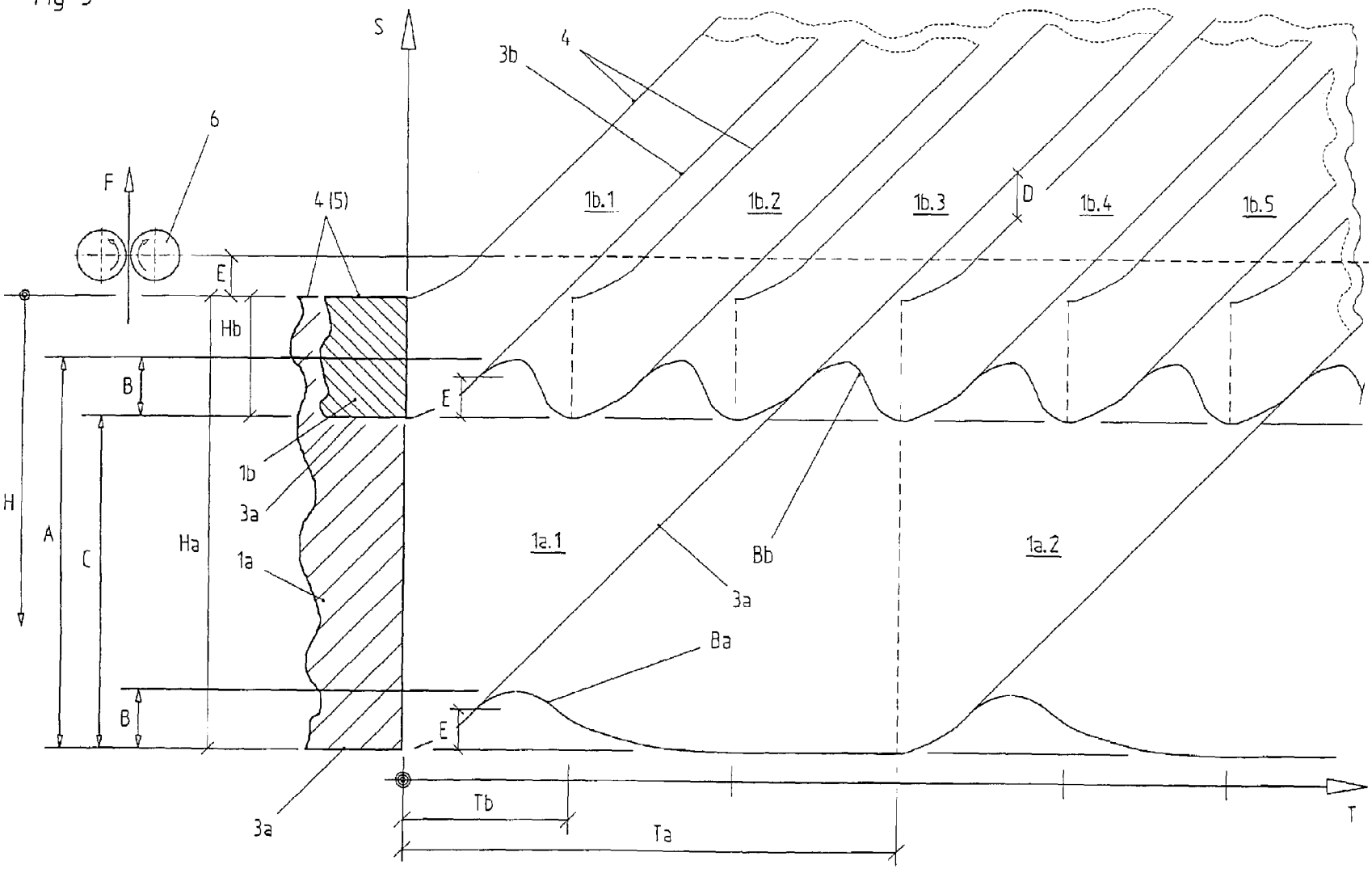
FIG. 3 shows a movement diagram of the device, wherein the movement profiles for a small format and a large format are represented.

The movement profiles with the aid of which the lowest sheet 1 in each case is advanced and transported onwards, are represented in the movement diagram in FIG. 3 for a small format and a large format in each case. The time T is plotted on the X-axis of the diagram, and the path S on the Y-axis. The gradient of the curves recorded in the diagram reproduces the level of the speed at which the elements represented move or are moved. For orientation purposes, the position of the pair of drawing-off rollers 6 is reproduced on the left, near the Y-axis. Located at a distance E behind the said position is the front-edge stop 5—to be identified by the fact that the front edges 4 of the sheets 1*a,* 1*b,* which are represented in hatched form, are disposed at that point. The sheet 1*a* represents the large format and has a sheet length Ha. Correspondingly, the sheet 1*b* is the small format, with a sheet length Hb.

The movement profile Ba of the cross-member 7 with the pushing-out elements 9 for the sheet 1*a* is represented in the lower region of the diagram. During the forward movement, the sheet 1*a* is pushed forwards at the rear edge 3*a* until the front edge 4 passes, after the length of path E, into the pair of drawing-off rollers 6, and the said sheet 1*a* is, from then on, transported onwards at the constant conveying speed of the said pair of rollers. At the point in time of take-over by the pair of drawing-off rollers 6, the movement profile Ba exhibits a pronounced zone of constant speed of advance, which speed of advance is synchronous with the drawing-off conveying speed. For a given setting of the unit 31, the stroke of the pushing out element 9 will be forward and back along a length B, which is sufficient for the rollers to grab and advance the sheet the remaining distance of greater than H−B to fully advance the sheet past the front end stop 5. During this advance by the rollers, the sheets are supported from below only by bearing strips 11 and bearing plates 12, but not at the back edge. On the return stroke of the pushing out element 9, the underside of the next bottom sheet lies on the advanced sheet until it falls down onto the bearing elements 11,12. The back edge of the next sheet lies on the flat surface to the right of the notch on pushing out element 9 until the pushing out element 9 moves with its shoulder or notch behind the rear edge of the next sheet (3*a* or 3*b*). On the return stroke of the pushing out element 9 the rear edge of the advanced sheet is no longer supported. After the taking-over operation, the cross-member 7 returns to its starting position. The next movement cycle for pushing out the sheet 1*a*.2 starts when the preceding sheet 1*a*.1 has passed the front-edge stops 5. This interrelation gives rise, for the movement profile Ba, to a clock-pulse time Ta and, derived therefrom, an isolating output of 1/Ta. The two sheets 1*a*.1 and 1*a*.2 are conveyed through the further-processing unit with a gap D.

The pushing-out of a small sheet 1*b* is conducted in a manner analogous with the above observations. Because of the shorter sheet length Hb, the movement profile Bb here exhibits a substantially lower clock-pulse time Tb, from which a high isolating output 1/Tb is derived. The gap D between the successive sheets 1*b*.1, 1*b*.2, 1*b*.3, etc. is identical to that when isolating and feeding the large sheet 1*a*. The logic for movement profiles Ba, Bb are derived, for the particular sheet length H, from a variably configured movement profile which has been stored in the position-controlling system 25. It will be perceived that the forward movement is almost identical, while the backward movement is carried out in a manner corresponding to the remaining time available.

In a given machine (e.g., device of EP 0464578, the disclosure of which is incorporated by reference) there is a substantially constant relationship between distance E and distance B. B is slightly greater than E to guarantee receiving the isolated sheet by the drawing-off rollers 6. In a given machine the distance C symbolizes the adjusting path.

Ha is the sheet length of a large sheet, and Hb the length of a short sheet. H shows also the distance between the front-edge stop 5 and the limiting element 20. The path of travel A arises approximately from the difference of Ha (length of large sheet) and Hb (length of short sheet) plus the isolating stroke B. The distance H−A is equal to Hb−B. In the illustrated embodiment the isolating stroke B is a constant unaffected by the sheet length H. According to the invention the isolating stroke B need not be constant for all length H of sheets. B could be programmed by one of ordinary skill in the art, to different stroke lengths.

The device is preferably part of a board-cutting installation, in which long sheets are cut from large-format sheets in a first step, and are then transferred into the device represented here and divided up into the desired final formats. The output of the entire plant is determined, in particular, by this second station. The device according to the invention results in new output potentials, since the sheets 1 are now isolated in dependence upon their sheet length H, and medium and smaller formats in particular, which make up by far the largest spectrum of board-cutting installations of this kind, are produced in a substantially higher production output. At the same time, the quality of the sheet blanks produced goes up, since the take-over takes place with an almost synchronous speed of the pair of drawing-off rollers 6 and the pushing-out elements 9.

The device according to the invention for isolating purposes is also suitable for feeding sheets to clock-pulse-controlled further-processing apparatuses. Use is then made of a fixedly configured movement profile with a fixed clock-pulse time or period. Because of the direct association of the linear motor 15 on the cross-member 7 which is moved forwards and backwards, and also because of the very low-friction linear guide 14, the pushing-out force applied can be employed for force-controlling the device. In addition to a general overload function, it is possible to push out the sheets 1 in a manner which treats the products gently, while observing an admissible pushing-out force which can be predetermined in the operating unit 31. To that end, the drawing-off speed of the pair of drawing-off rollers 6 is varied accordingly.

What is claimed is:

1. Device for isolating the lowest sheet in each case from a stack of sheets situated in a stack holder and feeding said lowest sheet in a travel direction into drawing off rollers, each sheet having a length in the travel direction between a front edge and a rear edge and opposed lateral edges, comprising:

a front edge stop on the stack holder, which permits passage of only the bottom sheet of the stack toward said drawing off rollers, the location of the front edge of said stack being at said front edge stop for all sheets of any sheet length (H);

a cross member situated below the holder and extending transversely to the travel direction;

a pushing-out element supported by the cross member, which grips the rear edge of the sheet in the stack and transports the sheet an isolating stroke distance (B) in the travel direction under the front-edge stop, into the drawing-off rollers, and having faces for vertically supporting the rear of the stack adjacent the rear edge;

means supporting the cross-member for moving the cross member and pushing out element forwards and backwards along the travel direction;

bearing elements supporting the underside of the stack adjacent the lateral edges;

lateral abutment strips for maintaining registry of the lateral edges of sheets of the stack;

a linear guide engaging the means supporting the cross member; and a linear motor operatively connected to the means supporting the cross-member, for linearly driving the movement of the cross member along a path of travel (A) that comprises both the isolating stroke (B) and an adjusting path (C) which is adjustable according to the sheet length (H); and a position-controlling system associated with the linear motor and the drawing off rollers for controlling the forward movement of the cross-member with the pushing-out elements in dependence upon the conveying speed of the drawing off rollers.

2. Device according to claim 1, wherein said position-controlling system associated with the linear motor and the drawing off rollers controls the forward movement of the cross-member with the pushing-out elements in dependence upon the conveying speed of the rollers in such a way that the lowest sheet is fed to said rollers at nearly synchronous speed.

3. Device according to claim 2, wherein the sheet is fed to the pair of drawing-off rollers at a higher speed than the conveying speed of drawing-off rollers.

4. Device according to claim 1, wherein said control system has control logic for a fixedly configured movement profile (B) for the forward and backward movement for clock-pulsed-synchronous feeding of the sheets to clock-pulse-controlled further-processing apparatuses.

5. Device according to claim 1, wherein that location of the isolating stroke (B) on the path of travel (A) which depends upon the sheet length (H) is determined by inputting the sheet length (H, Ha, Hb) in an operating unit associated with a position-controlling system.

6. Device according to claim 1, wherein the location of the isolating stroke (B) on the path of travel (A) is determined automatically by impingement, which is controlled by a sensor, against the rear edge of the stack from an outer position.

7. Device according to claim 1, wherein the linear motor is provided with an overload function.

8. Device according to claim 1, wherein the linear motor is force-controlled, an admissible pushing-out force for the particular sheet material to be processed is predetermined, and the speed of the pair of drawing-off rollers is controlled commensurate with said pushing-out force.

9. Device according to claim 8, wherein when the device is moved up along an approach ramp, adherence to the admissible pushing-out force is monitored, and that, when said pushing-out force is reached, the device is operated at the processing speed which has been reached up to that point.

10. Device according to claim 1, wherein the cross-member with the pushing-out elements is constructed with a suction device that acts upon the lowest sheet.

11. Device for isolating the lowest sheet in each case from a stack of sheets situated in a stack holder and feeding said lowest sheet in a travel direction into drawing off rollers, each sheet having a length in the travel direction between a front edge and a rear edge and opposed lateral edges, comprising:

a front edge stop on the stack holder, which permits passage of only the bottom sheet of the stack toward said drawing off rollers, the location of the front edge of said stack being at said front edge stop for all sheets of any sheet length (H);

a cross member situated below the holder and extending transversely to the travel direction;

a pushing-out element supported by the cross member, which grips the rear edge of the sheet in the stack and transports the sheet an isolating stroke distance (B) in the travel direction under the front-edge stop, into the drawing-off rollers, and having faces for vertically supporting the rear of the stack adjacent the rear edge;

means supporting the cross-member for moving the cross member and pushing out element forwards and backwards alone the travel direction;

bearing elements supporting the underside of the stack adjacent the lateral edges;

lateral abutment strips for maintaining registry of the lateral edges of sheets of the stack;

a linear guide engaging the means supporting the cross member; and a linear motor operatively connected to the means supporting the cross-member, for linearly driving the movement of the cross member alone a path of travel (A) that comprises both the isolating stroke (B) and an adjusting oath (C) which is adjustable according to the sheet length (H);

wherein the stack holder is supported by a frame; and wherein the linear motor has a secondary part which determines the path of travel (A) and is disposed on a carrying plate which is integral with the frame and a movable primary part fastened to the cross-member for driving the pushing out element as the secondary part of the motor moves relative to the primary part of the motor.

12. Device according to claim 11, wherein the linear guide is formed from two parallel guide rails which are disposed laterally along the path of travel (A) and are fastened on the carrying plate in a torsion and deflection-resistant manner, and from guide carriages which are fastened to the means for supporting the cross-member and associated with the respective guide rails.

13. Device according to claim 12, wherein the secondary part of the motor and the guide rails are attached to the underside of the carrying plate which is integral with the frame, and the primary part of the motor and the guide carriages are fastened to the means for supporting the cross-member.

14. Device according to claim 11, including a position-controlling system associated with the linear motor and the drawing off rollers for controlling the forward movement of the cross-member with the pushing-out elements in dependence upon the conveying speed of the rollers in such a way that the sheet is fed to said rollers at nearly synchronous speed.

15. Device according to claim 11, wherein control logic for a variably configurable movement profile (B, Ba, Bb) for the forward and backward movement is stored in a position-controlling system of the linear motor with respect to the sheet length (H) of the particular sheet format to be processed, in such a way that gaps (D), which are of predefinably equal size for different sheet lengths (H, Ha, Hb), are produced between the sheets which are being fed.

16. Device according to claim 2 wherein the linear motor is force-controlled, an admissible pushing-out force for the particular sheet material to be processed is predetermined, and the speed of the pair of drawing-off rollers is controlled commensurate with said pushing-out force.

17. Device according to claim 16, wherein when the device is moved up along an approach ramp, adherence to the admissible pushing-out force is monitored, and that, when said pushing-out force is reached, the device is operated at the processing speed which has been reached up to that point.

18. Device according to claim 13, including a position-controlling system associated with the linear motor and the drawing off rollers for controlling the forward movement of the cross-member with the pushing-out elements in dependence upon the conveying speed of the rollers in such a way that the sheet is fed to said rollers at nearly synchronous speed.

19. Device according to claim 13, wherein control logic for a variably configurable movement profile (B, Ba, Bb) for the forward and backward movement is stored in a position-controlling system of the linear motor with respect to the sheet length (H) of the particular sheet format to be processed, in such a way that gaps (D), which are of predefinably equal size for different sheet lengths (H, Ha, Hb), are produced between the sheets which are being fed.

20. Device according to claim 13, wherein the linear motor is force-controlled, an admissible pushing-out force for the particular sheet material to be processed is predetermined, and the speed of the pair of drawing-off rollers is controlled commensurate with said pushing-out force.

21. Device for isolating the lowest sheet in each case from a stack of sheets situated in a stack holder and feeding said lowest sheet in a travel direction into drawing off rollers, each sheet having a length in the travel direction between a front edge and a rear edge and opposed lateral edges, comprising:

a front edge stop on the stack holder, which permits passage of only the bottom sheet of the stack toward said drawing off rollers, the location of the front edge of said stack being at said front edge stop for all sheets of any sheet length (H);

a cross member situated below the holder and extending transversely to the travel direction;

a pushing-out element supported by the cross member, which grips the rear edge of the sheet in the stack and transports the sheet an isolating stroke distance (B) in the travel direction under the front-edge stop, into the drawing-off rollers, and having faces for vertically supporting the rear of the stack adjacent the rear edge;

means supporting the cross-member for moving the cross member and pushing out element forwards and backwards alone the travel direction;

bearing elements supporting the underside of the stack adjacent the lateral edges;

lateral abutment strips for maintaining registry of the lateral edges of sheets of the stack;

a linear guide engaging the means supporting the cross member; and a linear motor operatively connected to the means supporting the cross-member, for linearly driving the movement of the cross member along a path of travel (A) that comprises both the isolating stroke (B) and an adjusting path (C) which is adjustable according to the sheet length (H);

wherein control logic for a variably configurable movement profile (B, Ba, Bb) for the forward and backward movement is stored in a position-controlling system of the linear motor with respect to the sheet length (H) of the particular sheet format to be processed, in such a way that gaps (D), which are of predefinably equal size for different sheet lengths (H, Ha, Hb), are produced between the sheets which are being fed.

* * * * *

UNITED STATES PATENT AND TRADEMARK OFFICE

CERTIFICATE OF CORRECTION

PATENT NO. : 7,004,461 B2
APPLICATION NO. : 10/442412
DATED : February 28, 2006
INVENTOR(S) : Hansmann et al.

It is certified that error appears in the above-identified patent and that said Letters Patent is hereby corrected as shown below:

Column 8:

Line 19, delete “alone” and substitute --along--.

Line 28, delete “alone” and substitute --along--.

Line 30, delete “oath” and substitute --path--.

Column 9:

Line 1, delete “claim 2” and substitute --claim 11--.

Column 10:

Line 15, delete “alone” and substitute --along--.

Signed and Sealed this

Twenty-eighth Day of November, 2006

JON W. DUDAS
*Director of the United States Patent and Trademark Office*